US006131527A

United States Patent [19]

Park et al.

[11] Patent Number: 6,131,527

[45] Date of Patent: Oct. 17, 2000

[54] VACUUM BOX FOR USE WITH OVERLOCK SEWING MACHINES

[76] Inventors: Jong Rak Park, 1740 S. Los Angeles St., #108, Los Angeles, Calif. 90015; Paul Kim, 151 S. 9th Ave., Unit U, City of Industry, Calif. 91746

[21] Appl. No.: 09/347,549

[22] Filed: Jul. 6, 1999

Related U.S. Application Data

[60] Provisional application No. 60/123,390, Mar. 8, 1999.

[51] Int. Cl.[7] ..... D05B 81/00; A47L 5/36; A47B 1/10

[52] U.S. Cl. ..... 112/282; 15/303; 108/102

[58] Field of Search ..... 112/282, 287, 112/285, 288, 217.1, 260, DIG. 1, DIG. 2, DIG. 3; 206/829; 15/300.1, 303; 30/133; 83/910, 105, 936; 108/61, 65, 59, 67, 68, 102

[56] References Cited

U.S. PATENT DOCUMENTS

| | | | |
|---|---|---|---|
| 3,125,052 | 3/1964 | Spivey | 112/287 X |
| 4,123,124 | 10/1978 | Peets | 112/217.1 X |
| 4,393,801 | 7/1983 | Kato et al. | 112/282 |
| 5,775,245 | 7/1998 | Sato et al. | 112/260 |

FOREIGN PATENT DOCUMENTS

| | | | |
|---|---|---|---|
| 40872 | 9/1985 | Japan | 112/282 |
| 52897 | 3/1986 | Japan | 112/282 |

*Primary Examiner*—Ismael Izaguirre
*Attorney, Agent, or Firm*—Jerry H. Noh

[57] ABSTRACT

A vacuum box having features ideal for utilization with an overlock sewing machine housed in a flat-bed table in a garment factory setting. The vacuum flat-bed table of an overlock sewing machine. The vacuum box is a receptacle having bottom, top, left, right, front, and rear walls. A portion of the front wall can have an opening covered by a hingably mounted door panel. The receptacle has a first compartment and a second compartment. The first compartment is sealed-off from the first compartment and has a electric outlet placed therein placed along the left or right wall. A suction fan is located in the second compartment. A horizontally sliding top panel is placed above the top surface of the top wall. The top panel is pivotally connected to guide slots placed along the front and back wall of the receptacle in a manner which allows the top panel to be extended horizontally to increase the top surface and drawn in to reduce the top surface. The vacuum box of the present invention uses dual flexible vacuum hoses for maximal suction effect. A first vacuum hose and a second vacuum hose each connects at its first end to the receptacle and extends into the second compartment. Each vacuum hose connects at a second end to predetermined point on the sewing machine.

12 Claims, 6 Drawing Sheets

VACUUM BOX FOR USE WITH OVERLOCK SEWING MACHINES

RELATED APPLICATION

The following Application for Letters Patent claims priority from Provisional Application Ser. No. 60/123,390, filed Mar. 8, 1999.

FIELD OF THE INVENTION

This invention relates to a vacuum box for collecting miscellaneous particles of thread, dust, and fabric and, more particularly to a device for collecting the miscellaneous particles produced from the utilization of an overlock sewing machine.

BACKGROUND OF THE INVENTION

Widely used in the garment industry is a sewing machine of the overlock stitching type. The overlock machine is equipped with cutter knives for trimming away fabric edges. Use of the cutter knives generates a significant amount of waste in the form of lint dust, thread particles, and pieces of fabric. The user of the machine many times wear masks to cover his mouth and nose. Also, the user must stop intermittently the machine to remove some of the waste accumulating in the vicinity of the cutter knives. This can result in decreased productivity of the user.

To solve some of the problems caused by the waste, several vacuum devices have been developed to collect the waste produced by the overlock machine. One such vacuum machine for sewing machines is U.S. Pat. No. 5,669,319 issued to Liang. Liang teaches a collector box pivotally mounted to the sewing machine frame. A tubular conduit is used to connect the collector box to the portion of the flat-bed of the sewing machine where most of the waste fabric accumulates.

Another vacuum for sewing machines is taught by Kato in U.S. Pat. No. 4,375,712. Kato teaches a vacuum box having first and second different collection boxes with the second box having a suction hose of a larger diameter than the suction hose of the first box. The two suction hoses are attached at different portions of the sewing machine to optimally collect the waste generated by the machine.

What the prior arts lack is a vacuum box having features which optimizes its utility in functioning with an overlock machine. Overlock machines are housed in a flat-bed table typically of a standard height. Working space is a premium in a garment factory. The floors are usually filled with articles of garment, fabric, threads, and boxes. Also, free space on the surface of the flat-bed table is also usually filled with miscellaneous equipment and garments. Thus, a vacuum box which occupies minimal floor space while increasing top surface space is highly desirous.

A vacuum box can be designed having a height equal to that of the flat-bed table for placement adjacent to the flat-bed table. However, one problem is that most vacuum boxes have one or more suction hoses protruding from the box on the side facing the flat-bed. The positioning of the hoses requires that the vacuum box be displaced a predetermined distance from the flat-bed table causing a gap. Most users tend to utilize the flat space on the top surface of the vacuum box to place miscellaneous items. An extreme inconvenience is that many times, the items placed on top of the vacuum box fall through the gap. Many users try to fill the gap with various articles including boards and sheets of fabric.

Another feature of most garment factories is in the placement of electrical outlets. Due to the abundance of articles on the floor and placement of the machines throughout the area of the factory, electrical outlets are not placed along walls and floors. Instead the outlets are placed at a height above the workers on fixtures suspended from the ceilings or walls. The outlets are used to power each machine as well as radios, walkmans, and fans. Thus instead of electrical cords and cable cluttering the floor of the factory, electrical cords dangle suspended from outlets placed above the workers.

It is an object of the present invention to provide a vacuum box for a overlock machine which occupies minimal floor space of a garment factory while providing a wide top surface for the user.

It is another object of the present invention to eliminate the gap between the top surface of the vacuum box and the flat-bed table when the vacuum box is placed next to the table.

It is a further object of the present invention to provide a vacuum box for use in a garment factory which reduces the amount of electrical cords dangling from outlets located above the workers.

It is yet another object of the present invention to provide a vacuum box with all of the above features which is inexpensive to manufacture.

SUMMARY OF THE INVENTION

The present invention is a vacuum box with features ideal for utilization with an overlock sewing machine in a garment factory setting. The vacuum box is of a predetermined height substantially equal to the height of a conventional flat-bed table of an overlock sewing machine. The vacuum box of the present invention is ideal for placement adjacent to the table. The vacuum box is a receptacle having bottom, top, left, right, front, and rear walls.

A portion of the front wall can have an opening covered by a hingably mounted door panel, which can be made of a translucent material. The suction effect of the vacuum box is produced by a suction fan housed in a compartment within the receptacle.

Top surface space on the top of the vacuum box is maximized by the placement of a horizontally sliding top panel above the top wall. The top panel is pivotally connected to guide slots placed along the front and back wall of the receptacle in a manner which allows the top panel to be extended horizontally to increase the top surface and drawn in to reduce the top surface.

To eliminate the need to have multiple electrical dangling cords dangling from outlets placed above the workers in a garment factory, the vacuum box of the present invention further includes an electrical outlet placed along the left or right wall. Only one electrical cord connecting the vacuum box to the outlet placed above the worker is necessary. Thus, workers can simply use the outlet of the vacuum box for all other electrically powered items.

The vacuum box of the present invention uses dual flexible vacuum hoses for maximal suction effect. A first vacuum hose and a second vacuum hose each connects at its first end to the receptacle and extends into the receptacle. A second end of each of the first and second vacuum hose detachably connects to a predetermined point on the overlock machine for maximal collection of waste debris.

DETAILED DESCRIPTION OF THE PREFERRED EMBODIMENT

Figure 5:
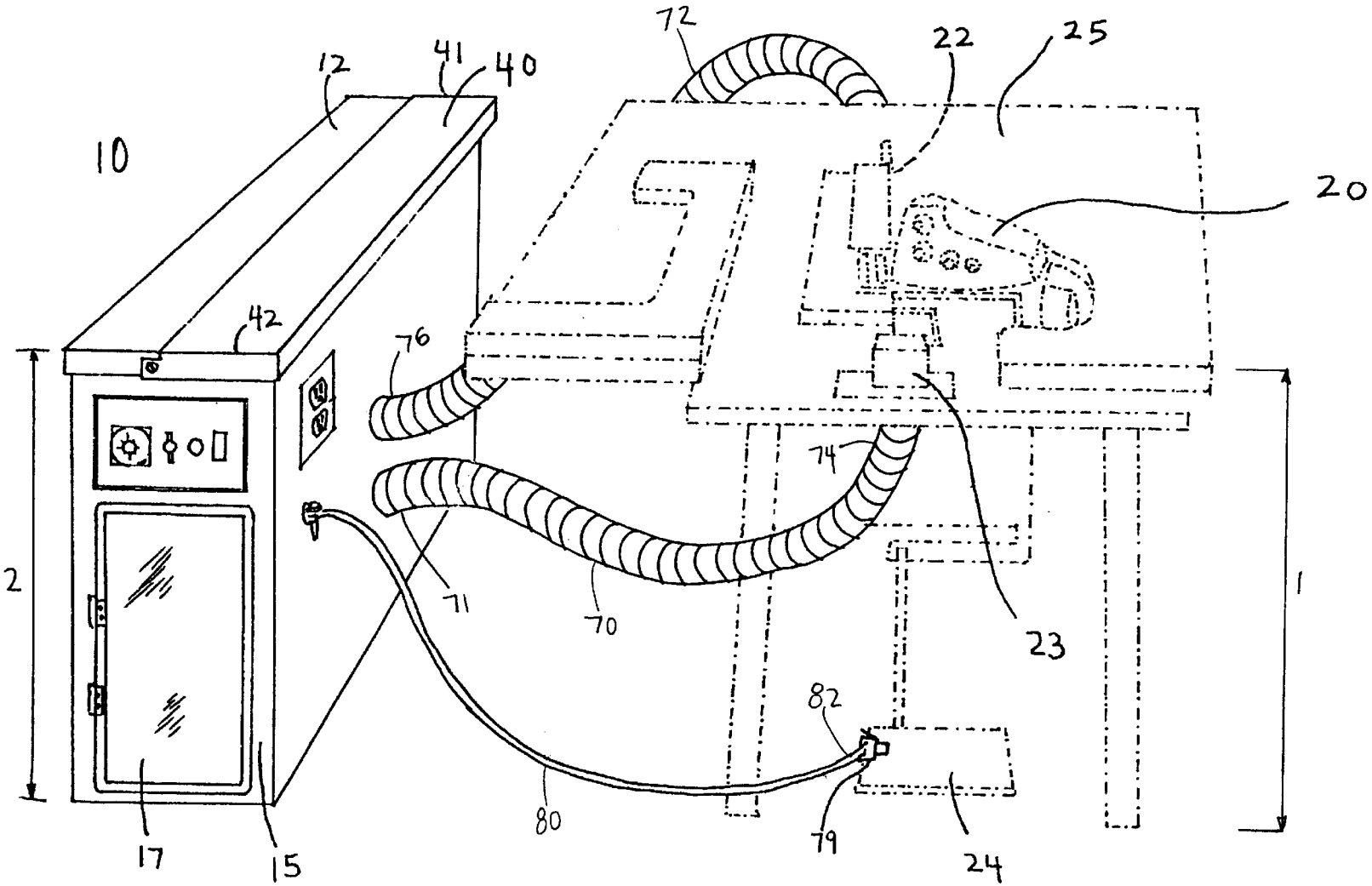
FIG. 5 is a perspective view of the present invention having the top panel drawn in and placed next to an overlock sewing machine housed in a flat-bed table, which is shown in phantom lines.
Figure 6:
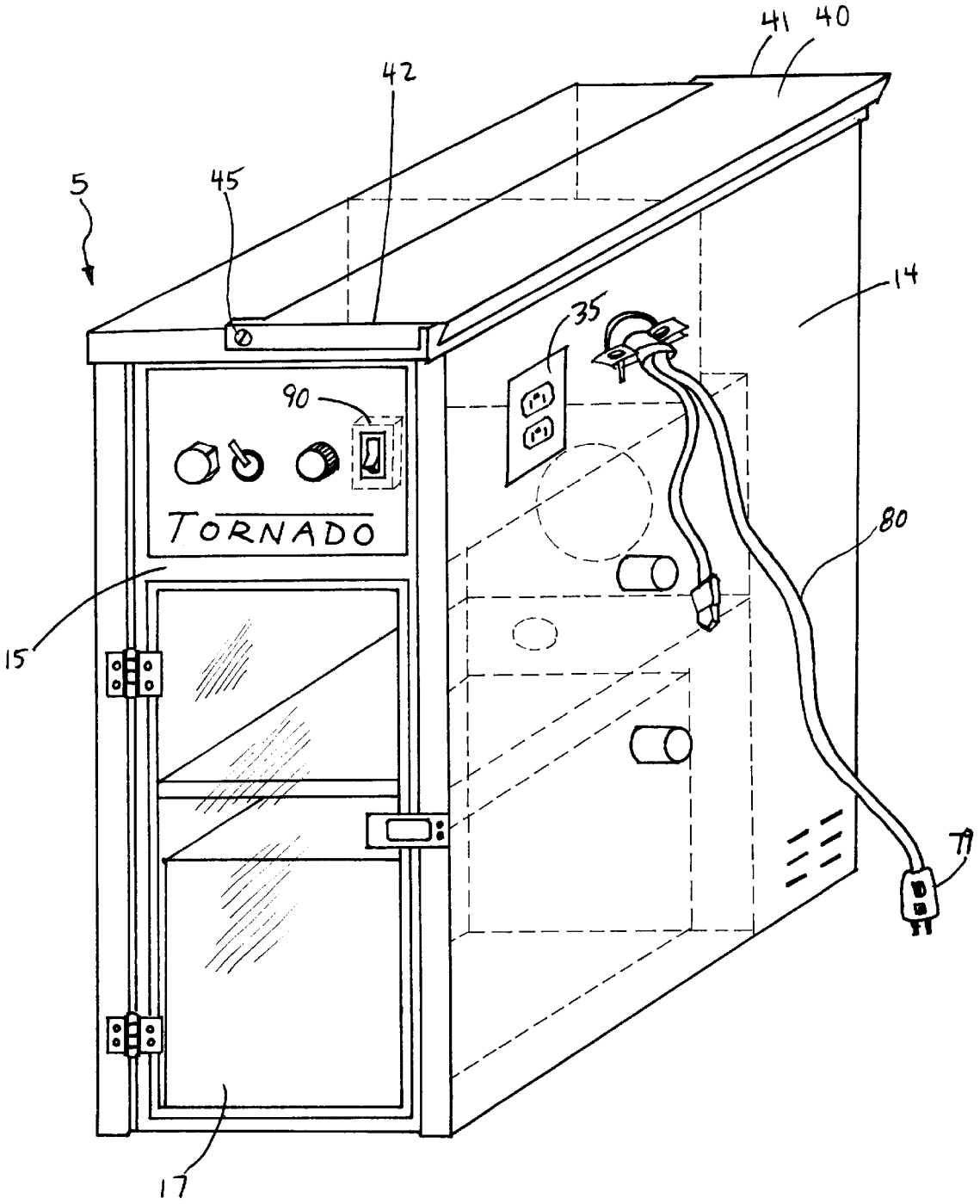
FIG. 6 is a perspective view of the present invention showing the inner compartments.

The vacuum box 10 of the present invention is in its preferred embodiment ideal for use with an overlock sewing machine 20 as shown in FIG. 5. This machine 20 is typically housed in a flat-bed table 25 of a standard size, configuration, and a first predetermined height 1. Furthermore this machine 20 has a flat surface, for supporting the fabric material to be stitched, a stitching needle (not shown), and overlock cutter knives (not shown). The machine also includes a first debris outlet 22 in line with the cutter knives of the overlock machine, for rearward escape of waste fabric and lint generated by the cutter knives; and a debris collection box 23 for downward dropping of waste cut threads generated by the chain cutter. The operation of the cutter knives is controlled by the pressing of a foot pedal 24.

Figure 1:
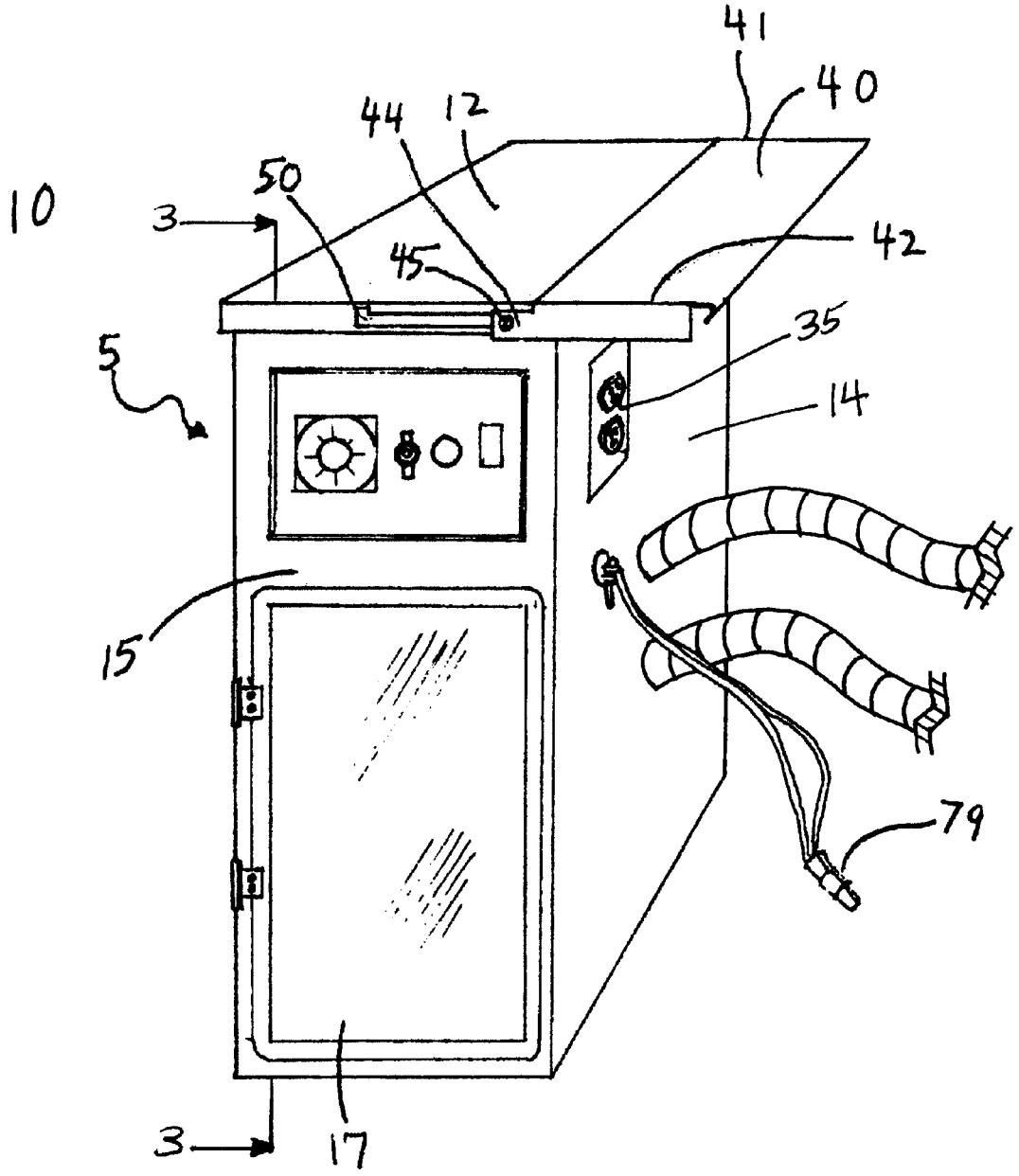
FIG. 1 is a perspective view of the present invention showing the top panel fully extended.
Figure 2:
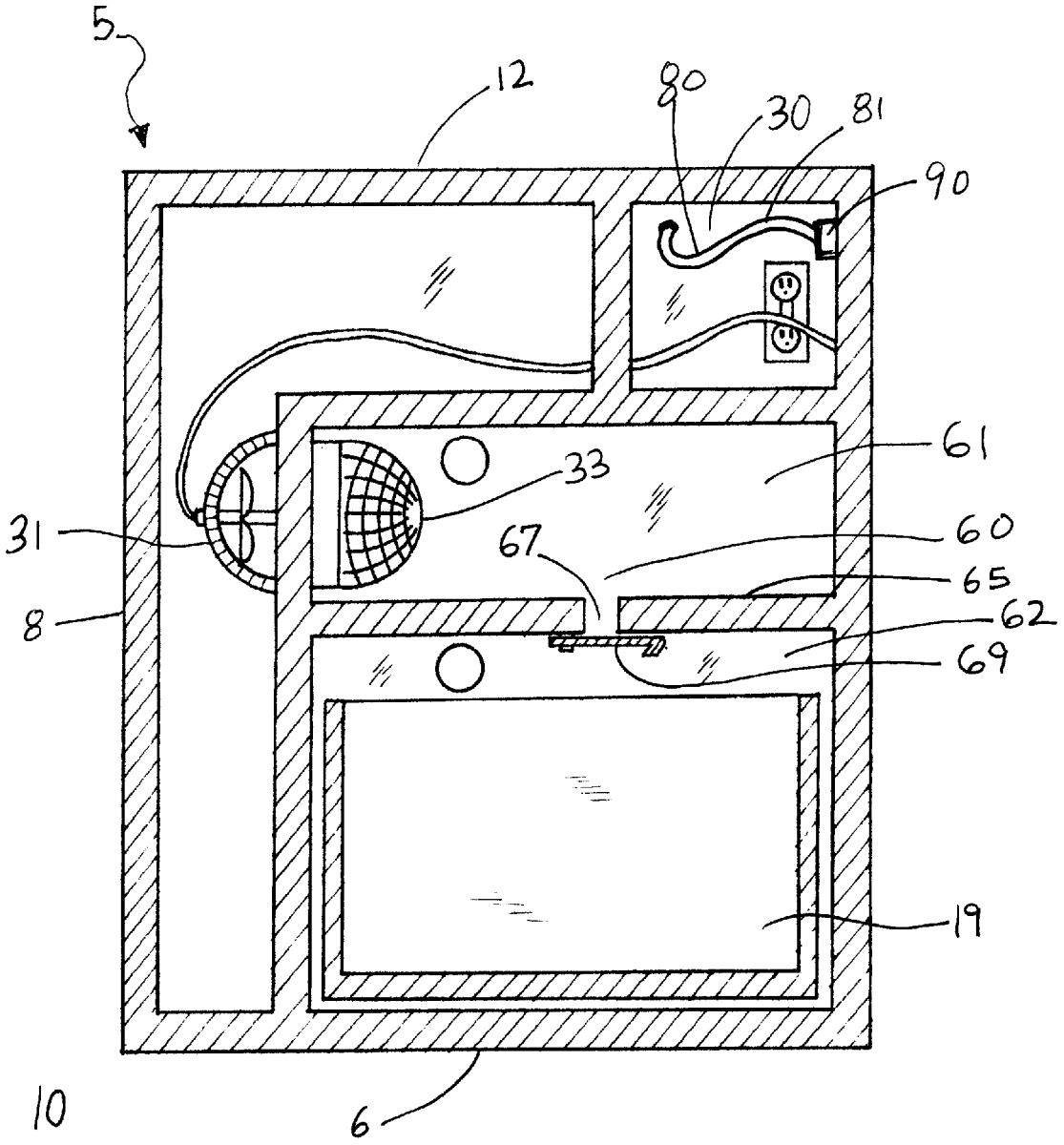
FIG. 2 is cross-sectional side view of the present invention cut along the 3—3 line and showing the inner components.
Figure 3:
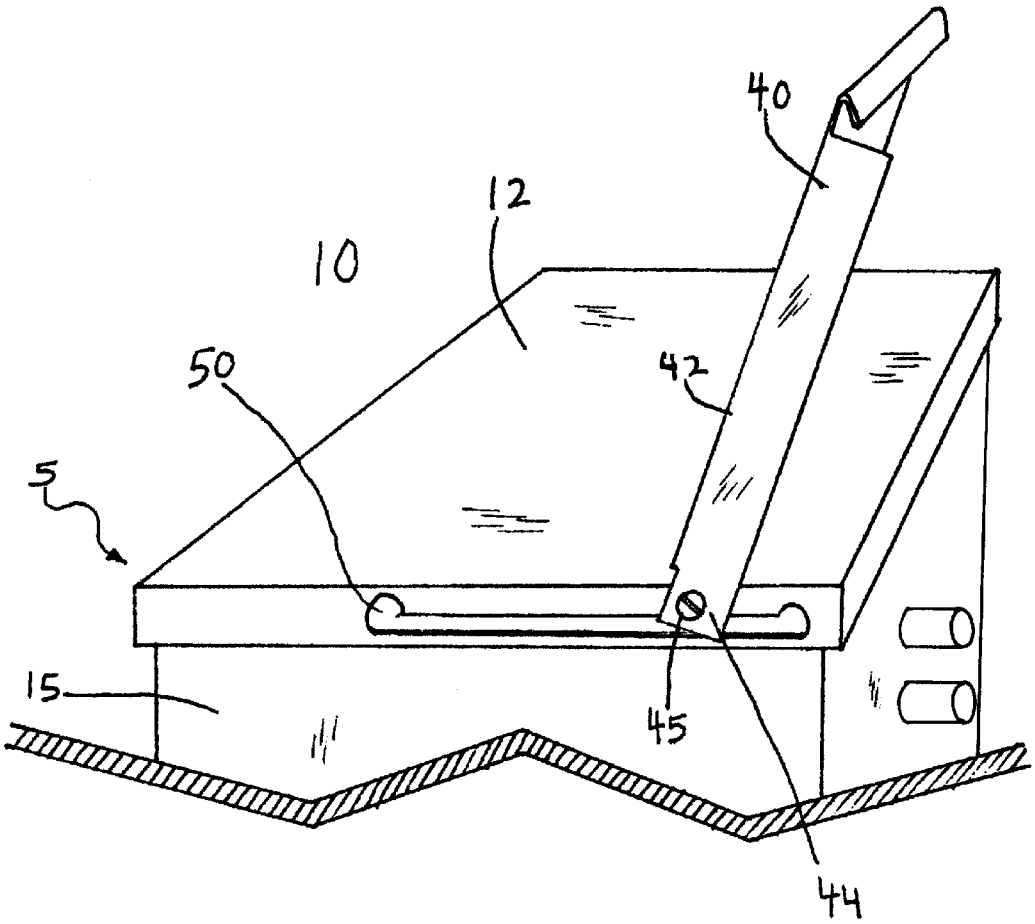
FIG. 3 is a perspective view of a portion of the present invention focusing mainly on the top panel and the top wall.

A first embodiment of the vacuum box is shown in FIGS. 1 to 3. The vacuum box 10 is a rectangular receptacle 5 having a bottom wall 6, top wall 12, left wall (not shown), right wall 14, front wall 15, and a rear wall 8. The receptacle 5 is of a second predetermined height 2 substantially equally to the first predetermined height 1 of the machine 20. A portion of the front wall 15 can have an opening covered by a hingably mounted door panel 17. The door panel 17 is ideal for insertion and removal of a collection bin 19 located within the receptacle 5 as shown in FIG. 2. The door panel 17 can be made of a translucent material so that a user can see into the receptacle 5 to determine when the collection bin 19 is full. As shown in FIG. 2, the receptacle 5 has a first compartment 30 and a second compartment 60. The first compartment 30 should be sealed-off from the second compartment, and an electrical outlet box 35 can also be placed in the first compartment 30 along the left or right wall 14.

The second compartment 60 is further divided into a first section 61 and a second section 62 by a compartment wall 65 located in the second compartment 65. A slot 67 is placed on the compartment wall 65, and a moveable cover 69 is hingeably mounted on the compartment wall 65 adjacent the slot 67. The cover 69 slides laterally to cover and uncover the slot 67. The first section 61 houses a suction fan 31. The suction fan 31 serves to draw air, debris, and other miscellaneous particles only into the first section 61 when the slot 67 is covered and into both the first section 61 and the second section 62 when the slot 67 is uncovered. A filtering device 33 can be placed over the suction fan 31 to filter the miscellaneous debris and particles from the suction fan 31.

Figure 4:
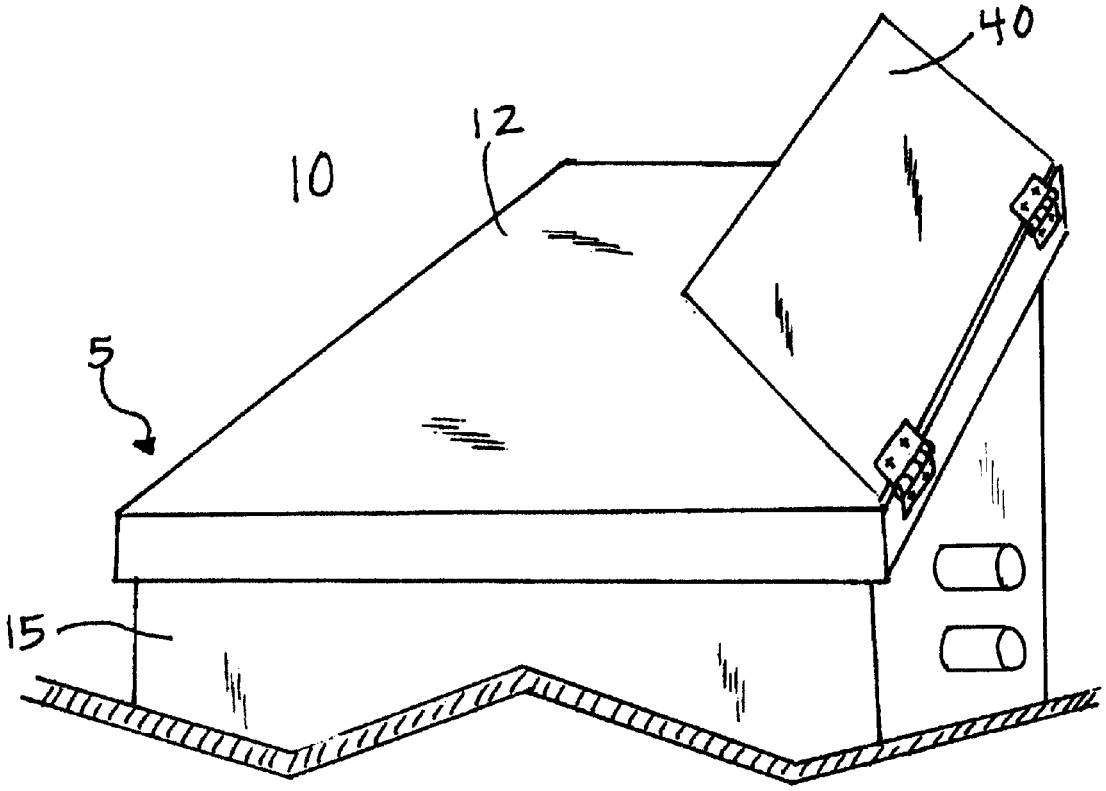
FIG. 4 is a perspective view of a portion of the present invention focusing mainly on the top panel and the top wall of a second embodiment of the present invention.

The vacuum box 10 of the present invention further includes a first connection means to pivotally attach a top panel 40 to the receptacle 5. As shown in FIG. 3, in the preferred embodiment the first connection means includes a horizontally extending first guide slot 50 located along the front wall 15 immediately below the top wall 12, and a horizontally extending second guide slot (not shown) identical to the first guide slot located along the rear wall 8 immediately below the top wall 12. The top panel 40 having first 41 and second 42 opposed parallel sides is located above the top panel 40 and is attached to slide horizontally. Each of the first 41 and second 42 sides has an identical protruding attachment end 44, and each attachment end 44 has an attached bracket 45. The top panel 40 is pivotally attached to the receptacle 5 with each bracket inserted within the corresponding first 50 and second guide slot. The top panel 40 can slide horizontally along the first 50 and second guide slot to create an extended top surface as shown in FIG. 1. When the top panel 40 is not extended horizontally, it lies in a flush relationship with the top wall 12 as shown in FIG. 5. In a second embodiment of the present embodiment as shown in FIG. 4, the first connection means includes hinged brackets 60 connecting the top panel 40 to either the left or right wall 14 of the receptacle 5.

When operating with an overlock sewing machine 25 as shown in FIG. 5, the vacuum box 10 includes a flexible first vacuum hose 70 and second vacuum hose 72. The first vacuum hose 70 is connected at a first end 71 to the receptacle 5 and extends into the second section 62, and a second end 74 is connected to the debris collection box 23 of the machine. The second vacuum hose 72 is connected at a first end 76 to the receptacle 5 and extends into the first section 61, and a second end (not shown) is connected to the first debris outlet 22 of the machine 20.

Another feature of the preferred embodiment is a cable 80 protruding from the receptacle 5 to the foot pedal 24 of the overlock machine 20. As shown in FIGS. 2 and 5, the cable 80 is connected at a first end 81 to a central activation unit 90 within the receptacle 5 which controls the operation of the suction fan 31. Attached to a second end 82 of the cable 80 is a step switch 79. The step switch 79 can be placed on the foot pedal 24 so that pressing down on the foot pedal 24 will activate the suction fan 31 and the cutter chain, and releasing the foot pedal 24 will deactivate the suction fan 31 and cutter chain.

What is claimed as being new and therefore desired to be protected by letters patent of the United States is as follows:

1. A vacuum box comprising:

a rectangular receptacle having bottom and top walls, left and right walls, front and rear walls;

a first compartment disposed within said receptacle;

a second compartment disposed within said receptacle housing a suction fan;

a horizontally sliding rectangular top panel having a first and second opposed parallel sides disposed on said top wall;

each of said first and second sides of said top panel having an attachment end; and, means to move said top panel horizontally.

2. The vacuum box as described in claim 1 wherein the means to move said top panel horizontally comprises:

a horizontally extending first guide slot disposed on said front wall immediately below said top wall;

a horizontally extending second guide slot disposed on said rear wall immediately below said top wall;

a bracket disposed on said attachment ends of each of said first and second sides of said top panel, said top panel being pivotally connected to said receptacle by each of said brackets being disposed on a corresponding guide slot.

3. The vacuum box as described in claim 1 further comprising:

a flexible first vacuum hose connected at one end to said receptacle and leading into said second compartment; and, a flexible second vacuum hose connected at one end to said receptacle and leading into said second compartment.

4. The vacuum box as described in claim 1 further comprising an electric outlet disposed within said first compartment along said right wall.

5. The vacuum box as described in claim 1 further comprising:

a collection bin disposed within said second compartment; and, a hingably mounted door forming part of said front panel.

6. A vacuum box for operation with a conventional overlock sewing machine housed in a flat-bed table of a predetermined height, said machine being operational by the pressing of a foot pedal, comprising:

a rectangular receptacle having bottom and top walls, left and right walls, front and rear walls;

a first compartment disposed within said receptacle;

a second compartment disposed within said receptacle;

a compartment wall disposed within said second compartment dividing said second compartment into two halves, namely, a first section and a second section;

a suction fan disposed within said first section of said second compartment;

a slot disposed on said compartment wall;

a moveable cover for covering and opening said slot;

a horizontally sliding rectangular top panel having a first and second opposed parallel sides disposed on said top wall;

each of said first and second sides of said top panel having an attachment end; and, means to move said top panel horizontally.

7. The vacuum box as described in claim 6 wherein the means to move said top panel horizontally comprises:

a horizontally extending first guide slot disposed on said front wall immediately below said top wall;

a horizontally extending second guide slot disposed on said rear wall immediately below said top wall;

a bracket disposed on said attachment ends of each of said first and second sides of said top panel, said top panel being pivotally connected to said receptacle by each of said brackets being disposed on a corresponding guide slot.

8. The vacuum box as described in claim 6 further comprising:

a flexible first vacuum hose connected at one end to said receptacle and leading into said first section of said second compartment; and, a flexible second vacuum hose connected at one end to said receptacle and leading into said second section of said second compartment.

9. The vacuum box as described in claim 6 further comprising an electric outlet disposed within said first compartment along said right wall.

10. The vacuum box as described in claim 6 further comprising:

a collection bin disposed within said second section of said second compartment; and, a hingably mounted door forming part of said front panel.

11. The vacuum box as described in claim 6 wherein the receptacle is of a second predetermined height substantially equal to the height of the flat-bed table.

12. The vacuum box as described in claim 7 further comprising:

a central activation unit within the receptacle controlling the operation of said suction fan;

a cable protruding from said receptacle having a first end connected to said central activation unit; and, a step switch attached to said cable opposite said first end of said cable.

* * * * *